US005253698A

United States Patent [19]

Keough et al.

[11] Patent Number: 5,253,698

[45] Date of Patent: Oct. 19, 1993

[54] COMBINATION SAND CLEANING AND HEAT TREATING APPARATUS FOR SAND CASTED METALLIC PARTS AND METHOD

[75] Inventors: John R. Keough; William R. Keough, both of Birmingham; Bela V. Kovacs, Bloomfield Hills, all of Mich.

[73] Assignee: Applied Process, Livonia, Mich.

[21] Appl. No.: 841,418

[22] Filed: Feb. 26, 1992

Related U.S. Application Data

[63] Continuation-in-part of Ser. No. 769,581, Oct. 2, 1991, abandoned, which is a continuation of Ser. No. 469,089, Jan. 23, 1990, abandoned.

[51] Int. Cl.[5] ..... B22D 29/00; B22D 30/00

[52] U.S. Cl. ..... 164/269; 164/270.1; 164/5; 148/538

[58] Field of Search ..... 164/269, 270.1, 76.1, 164/5; 148/3; 241/DIG. 10, 171, 170

[56] References Cited

U.S. PATENT DOCUMENTS

| | | | |
|---|---|---|---|
| 1,712,082 | 5/1929 | Koppers | 241/170 |
| 2,332,701 | 10/1943 | Dowsett | 241/170 |
| 2,420,376 | 5/1947 | Johansson | 241/170 |
| 2,592,783 | 4/1952 | Aspegren | 241/171 |

FOREIGN PATENT DOCUMENTS

| | | | |
|---|---|---|---|
| 2726931 | 12/1977 | Fed. Rep. of Germany | 164/269 |
| 2751500 | 9/1978 | Fed. Rep. of Germany | 164/5 |
| 2914221 | 10/1980 | Fed. Rep. of Germany | 164/5 |
| 58-25860 | 2/1983 | Japan | 164/269 |
| 59-39464 | 3/1984 | Japan | 164/76.1 |

*Primary Examiner*—Kuang Y. Lin
*Attorney, Agent, or Firm*—Cargill & Bliss

[57] ABSTRACT

Sand castings are removed from their molds before cooling and reheated in a heat treating booster furnace. The castings are transferred from the booster furnace to a rotary drum filled with agitation media. As the castings pass through the media drum, they are simultaneously cleaned of sand particles and down-quenched by the agitation media. The system is particularly suited for austempering cast iron parts.

36 Claims, 1 Drawing Sheet

COMBINATION SAND CLEANING AND HEAT TREATING APPARATUS FOR SAND CASTED METALLIC PARTS AND METHOD

This is a continuation-in-part of co-pending application Ser. No. 07/769,581, filed on Oct. 2, 1991, which, in term is a continuation application of Ser. No. 469,089, filed on Jan. 23, 1990, both now abandoned.

TECHNICAL FIELD

This invention relates generally to sand casting and particularly relates to a continuous process for cleaning and simultaneously heat treating metal sand castings

BACKGROUND OF THE INVENTION

Sand casting has long been used to form cast metal parts such as pistons, crankshafts, connecting rods and engine blocks. Although sand casting is a generally economical method of producing cast metal parts, it is typically considered labor intensive, particularly insofar as removing the mold sand from the cast parts. More particularly, whether manual or mechanized procedures are used for scraping, brushing and/or abrading the mold sand from the cast parts, it is generally held that removing such sand from a casting is one of the most expensive aspects of foundry processing. Conventional methods in which operators blow the sand off the cast parts with pressurized air have been known to require one-third of the total energy requirement of making a cast part. Before air-blasting, the cast part must also be cooled for handling. Later, the cast part will have to be reheated for heat treatment, if heat treatment is desired. In the practice of this prior art method, laborers use shop air sources with a nozzle to individually blow the loose sand from the sand-casted metal parts. This poses three particular problems: (1) the blow-off is labor intensive; (2) very high noise levels due to the blow-off operation render OSHA compliance difficult in order to avoid hearing loss of the laborers; and (3) time requirements are too high because the part must be cooled before it is blown off, requiring re-heating at a later time to perform heat treatment. Furthermore, the previous method was inefficient because the residual heat left over from the casting process if not utilized for the heat treatment process because the laborers cannot handle metal parts at 1400°-1700° F. in order to blow-off the clinging sand.

An additional expense associated with sand casting is the cost of reclaiming the foundry sand. That is, once the sand has been removed from the cast parts, the sand, which is typically in the form of sand clumps, must be further reduced to individual sand grains. The grains must then be cleaned and screened before they may be used to form a new mold.

Once a typical sand casting has been cleaned, it is often subjected to additional processing such as machining and heat treating. For heat treating, the cast part, which has cooled to room temperature, is reheated to a predetermined elevated temperature for a predetermined length of time to achieve certain desired properties in the treated part. One such treatment is known as austempering wherein the cast parts are tempered to improve their toughness. This type of heat treatment is not only time consuming, it is also relatively expensive and is often accomplished outside the foundry in independent heat treatment facilities.

Accordingly, a need exists for an efficient and economical method and apparatus for removing sand from metal sand castings and the like and for allowing simultaneous reclamation, cleaning and screening of the sand for reuse. A further need exists for a more economical method and apparatus for heat treating metal sand castings within the foundry.

SUMMARY OF THE INVENTION

The present invention has been developed to fulfill the needs noted above and therefore has as a primary object the provision of a method and apparatus for simultaneously cleaning and heat treating metal sand castings directly within the foundry by contacting the sand casted parts with agitation media while the parts are still hot enough to be heat treated. Also provided is a method and apparatus for simultaneously removing sand particles from metal castings while cleaning the sand particles by burning off bonding agents such as organic materials used during mold preparation.

Still another object is to provide a method and apparatus which heat treats sand castings using their own residual heat so as to reduce the energy input required for heat treatment.

Briefly, the present invention includes an automated conveyor system which transports hot sand castings from a mold removal device into a booster furnace which reheats the hot castings to a desired heat treating temperature. The castings are conveyed through the furnace and into a rotary media drum which is charged with agitation media formed of a heat-sink material which does not melt at the temperatures of the incoming metal castings. The shot enters the media drum at a predetermined quench temperature so that when the castings pass through the media drum they are down-quenched by the shot.

A particular advantage gained by the present invention is the simultaneous cleaning and heat treating of sand castings as they pass through the media drum. By using a media drum to both clean and quench the sand castings in this manner, additional heat treatment for certain castings may no longer be required. This is particularly true in the case of austempered parts which may be sufficiently austempered in the foundry using this invention which thereby obviate costly heat treatments outside the foundry.

BRIEF DESCRIPTION OF THE DRAWINGS

The nature and extent of the present invention will be clear from the following detailed description of the particular embodiments thereof taken in conjunction with the appendant claims, in which:

DETAILED DESCRIPTION OF THE INVENTION

Figure 1:
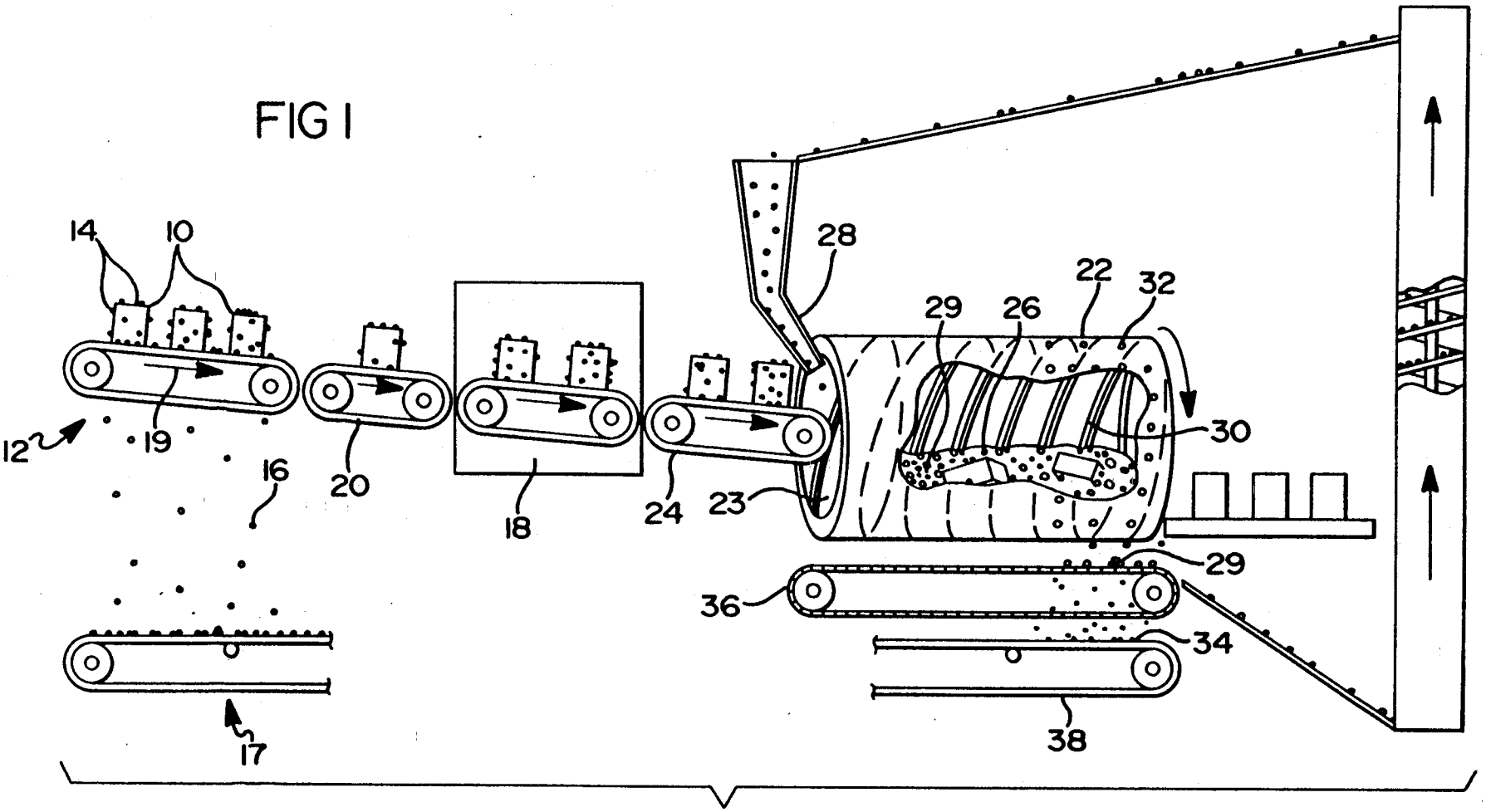
FIG. 1 is a schematic view of an automated system in operation for cleaning and heat treating sand castings according to the invention.

As seen in FIG. 1, hot cast parts 10 are placed on shakeout apparatus 12 which separates the cast parts from their sand molds. During the shakeout process, unified portions of the sand molds 14 are broken down into smaller clumps 16, which fall through openings in the shakeout apparatus 12 to sand reclamation apparatus 17 below, leaving cast parts 10 coated with an uneven layer of sand particles. Shakeout apparatus 12 is preferably angled downward to allow cast parts 10 to be transported in the direction of arrow 19 as shown. Shaker apparatus 12 is wellknown in the art and its details do not form a part of this invention. Before the cast parts cool down, they are transferred into furnace 18, e.g. via conveyor 20 which is associated with shakeout apparatus 12. The furnace 18 is located closely enough to the place of cating the parts 10 and to the shakeout apparatus 12 that, upon entry of the hot cast parts 10 into the furnace 18, their temperature typically falls only to no lower than about 1400° to 1500° F. As this temperature is not sufficient for desired heat treatments to be later performed, the temperature of the parts must be boosted to about 1500° to 1800° F.

Furnace 18, which may take the form of a luminous wall gas-fired booster furnace, boosts the temperature of hot sandy cast parts 10 to a uniform temperature. For example, in the case of cast iron parts, the furnace may be operated to raise the temperature of the parts to about 1500° F. to 1700° F. for subsequent austempering heat treatment. As will be realized by one skilled in the art, different temperatures will be required for different types of parts, although these temperature ranges are typical. Typically, the residence time within the furnace is from about 10–30 minutes, again, depending on the parts being heated. The furnace may be further equipped with a shake walker conveyor angled downward in the direction of the cast-part travel for supporting and further shaking the sand off the cast parts. The furnace may have perforations on the bottom to allow the loose sand to fall below and be captured by a sand reclamation apparatus.

Once hot cast parts 10 are suitably heated in furnace 18, they are removed to an agitation container such as rotary media drum 22. For example, hot cast parts 10 may be automatically transferred from furnace 18 to media drum 22 via conveyor system 24 which interconnects the furnace and the media drum or may be directly dumped into the media drum from the furnace. Rotary media drum 22 is preferably structured similar to a DIDION Rodary Media Drum manufactured by Didion Manufacturing Company, St. Peters, Miss., but with some important differences. One important difference is that the drum has perforations at its outlet end which will hereinafter be described in greater detail. Media drum 22 has large inlet opening 23 at its inlet end and an outlet opening (not shown) at its outlet end. Preferably, the outlet opening is smaller than the inlet opening.

As hot cast parts 10 enter media drum 22, they are submerged in an agitated bath of agitation media 26. Agitation media 26 may consist of pellets 29 which may be made of any suitable material which is of a size and composition adequate to simultaneously clean the residual adhering sand from the cast metal parts 10 by impact, and downquench the cast metal parts 10 by removing heat from them by conductive contact. It is critical that the agitation media 26 must be massive enough (a function of diameter and density) to remove the sand by impact, yet small enough in size to have good conductive contact with the surfaces of the parts 10 being treated, in order to achieve good quenching.

The agitation media 26 preferably has a melting point above the temperature of the hot cast parts 10 as the cast parts 10 enter the media drum 22. The agitation media 26 is also preferably non-reactive with and non-adhering to the hot cast parts 10 at that same temperature. In view of the grain size of conventional foundry sand, the diameter of the pellets 29 of the agitation media 26 should be at least about 1 millimeter, preferably on the order of 1 to a few millimeters, for treating ferrous cast parts 10 composed mainly of iron. The pellets 29 should also have a surface hardness adequate to resist fracturing during use and to remove the residual adhering sand from the cast parts 10 by impact against them.

For example, for ferrous cast parts 10, preferred pellets are copper and steel shot, having a diameter, e.g., of about 1 millimeter. Any conceivable shape of elements forming agitation media 26 may be used. Preferably, agitation media 26 is present in amounts of about 10 pounds per pound of cast part. Agitation media 26 is constantly being added to media drum 22 at spout 28 to maintain a desired level of agitation media in the drum, making up for agitation media exiting from the media drum as hereinafter described. Preferably, the media drum is filled about ⅓ full with agitation media, shown as shot 29. For example, it has been found suitable to fill a drum having a three foot diameter to about a one foot level. In order to heat treat hot cast parts 10, the incoming agitation media may be heated to a predetermined temperature capable of performing heat treating. For example, in order to austemper the surface regions of hot cast iron parts, incoming steel shot agitation media may be maintained at a temperature of about 700° F. One such device for maintaining the shot temperature may be a cooling conveyor which circulates the shot recovered from the media drum through a cooling medium, such as air, and readmits the shot through spout 28 after it has cooled, detailed below.

Rotary media drum 22 is preferably equipped with an internal helical vane or worm screw 30 which agitates hot cast parts 10 and agitation media 26 as the drum rotates in the known fashion. As the agitation media impact the surface of hot cast parts 10, most of the residual sand clinging to their surfaces is removed. At the same time, contact between agitation media 26 and hot cast parts 10 results in a controlled predetermined rate of heat transfer from the hot cast parts to the agitation media. This heat transfer quenches the hot cast parts and may be controlled to austemper the hot cast parts.

It can be appreciated that, as hot cast parts 10 are transported through the rotary media drum 22 via the action of helical vane 30, the hot cast parts are simultaneously quenched and cleaned of sand particles via impact with agitation media 26. The time which hot cast parts 10 spend in rotary media drum 22 may be controlled by conventional techniques such as by controlling the speed of the drum rotation. A 50-foot long 3-foot diameter drum, operated at 15 rotations per hour, and resulting in a two-hour residence time and moving about 50 tons of combined parts and shot per hour has been found to work well for cast iron parts such as gears and other like parts.

Through the walls of media drum 22 at the outlet end are perforations 32 large enough to allow pellets 29 and sand grains 34 to pass therethrough. A media drum having a length of 50 feet with 25-two foot long flights of a helical vane has been found suitable. Preferably, on this design media drum, perforations 32 are located in the area of only the last three flights nearest the outlet end of the media drum, i.e. about the last 10–15% of the length of the media drum. One "flight" is considered to be a 360° rotational length of the helical vane. Pellets 29 and sand trains 34 exiting via perforations 32 are reclaimed, e.g. by the process shown in FIG. 1 wherein falling pellets 29 and sand grains 34 fall onto a screened cooling conveyor belt 36 which has a mesh size such that pellets 29 are caught and sand grains 34 pass through. Alternatively, the shot may be magnetically removed from the sand and moved onto the cooling conveyor 36. Sand grains 34 are then caught by a sand reclamation apparatus, such as conveyor 38 as shown. Sand reclamation apparatus 17 and 38 may be one and the same, as the sand reclamation apparatus can extend from one end to the other end of the entire cleaning—heat treatment apparatus. The screen of screened conveyor belt 36 may be constructed of electromagnetic material to further aid in catching pellets 29, if the shot is metallic.

Pellets 29 exiting from media drum 22 are at a higher temperature than pellets 29 entering the media drum due to the heat transferred from cast parts 10 to pellets 29. Consequently, the agitation media 26 or pellets 29 which enter the rotary drum at a temperature of about 700° F. will be heated by the hot cast parts 10 more and more as they both travel through drum 22 until pellets 29 are themselves at a temperature of about 1000°-1700° F. To cool pellets 29 to the desired temperature for re-filling media drum 22, pellets 29 may be conveyed on an open-air conveyor which is designed to be long enough for pellets 29 to cool in air before being returned into media drum 22 at spout 28. Any other conventional cooling means may be employed for this purpose. Known liquid cooling devices may be used.

Cast parts 10, upon exiting media drum 22 at the outlet end are both heat-treated and substantially free of attached sand particles. Preferably, media drum 22 is designed so that substantially all of the pellets and sand fall through perforations 32 of media drum 22 so that only cast parts 10 exit through the outlet opening of media drum 22.

In addition to creating clean heat treated cast parts, a particular benefit is achieved by heating sand particles 34 in booster furnace 18 and rotary media drum 22 in that the foundry sand which is reclaimed by agitation has itself been cleaned insofar as any organic matter present in the sand has been burned off in booster furnace 18 and rotary media drum 22. Moreover, any clumps of sand adhering to cast parts 10 are reduced to individual grains during agitation and screened through screened conveyor belt 36 so that only unbonded screened sand is returned to sand reclamation system 38. In addition, the entire apparatus provides improved dust control over current methods, especially since the cleaning of the sand from the cast parts is accomplished in a predominantly enclosed container. the media drum. The apparatus also results in less noise production than current methods.

The heat treating and cleaning apparatus described above, is particularly useful for austempering hot cast iron parts. Austempering is a well known and widely used heat treatment because it produces cast iron parts which exhibit superior properties over "as cast" or quenched and tempered parts. Since hot cast parts 10 are cooled in a bath of steel shot or the like directly within the foundry, i.e. as soon as the parts are removed from their sand molds and reheated, the parts need not be shipped out for additional heat treatment. This results in significant savings and effort.

Hot cast parts 10 which are fully austempered in rotary media drum 22 will exhibit the superior properties of an austempered grain structure and will not typically require any additional heat treatment. A further savings is realized by using the residual heat in the hot cast parts provided during the casting process for heat treatment of the parts so as to minimize the energy input required for heat treatment, particularly the heat required in booster furnace 18. Finally, because the surfaces of hot cast parts 10 are cleaned and abraded by agitation media 26, subsequent finishing operations are facilitated and thereby reduced in cost.

Obviously, numerous modifications and variations of the present invention are possible in light of the above teachings. It is therefore to be understood that within the scope of the appended claims, the invention may be practiced otherwise than as specifically described herein.

We claim:

1. An apparatus for simultaneously heat treating and cleaning sand from hot, demolded sandcast metal parts having residual sand adhering thereto, comprising:

a booster furnace adapted to heat hot demolded sandcast metal parts to an appropriate heat treatment temperature;

a flow-through agitation container which receives the metal parts from the booster furnace;

means for transporting the metal parts from the booster furnace to the agitation container;

a flowing, non-melting, non-reactive agitation media partly filling the agitation container; and means for agitating the agitation media around and in contact with the metal parts;

the agitation media being smaller in size than the metal parts and of a size and composition simultaneously adequate to clean the residual adhering sand from the metal parts by impact, and to quench the metal parts by removing heat from the metal parts by contact.

2. The apparatus of claim 1, wherein said agitation container has perforations sized to allow agitation media and sand inside the agitation container to fall through.

3. The apparatus of claim 1, further comprising an entry spout associated with the agitation container for filling the agitation container with the agitation media.

4. The apparatus of claim 1, wherein said agitation media is selected from the group consisting of steel and copper shot.

5. The apparatus of claim 1, wherein the temperature of the agitation media is about 700° F. upon entering the agitation container.

6. The apparatus of claim 1, wherein said agitation container is a rotary drum.

7. The apparatus of claim 6, wherein said drum has an inlet opening at one end and an outlet opening at the other end.

8. The apparatus of claim 7, wherein said drum has perforations near the outlet opening sized to allow the agitation media and sand in the drum to fall through.

9. The apparatus of claim 8, wherein said perforations are located at about 10-15% of the length of the drum nearest the outlet opening.

10. The apparatus of claim 7, wherein the agitation means comprises a worm screw attached within the interior of the rotary drum for urging the metal parts, agitation media, and sand through the drum from the inlet opening to the outlet opening.

11. The apparatus of claim 1, wherein the booster furnace raises the temperature of the parts to between about 1500° F. and about 1700° F.

12. The apparatus of claim 1, wherein the agitation media has a diameter of at least about 1 millimeter.

13. An apparatus for simultaneously tempering and cleaning sand from hot, demolded sand-cast metal parts having residual sand adhering thereto, comprising:

(a) a booster furnace adapted to boost the temperature of hot demolded sand-cast metal parts to an appropriate elevated pre-tempering temperature;

(b) a flow-through agitation container for cleaning and quenching the metal parts, and a flowing, non-melting, non-reactive heat sink agitation media partially filling said container, the agitation container being equipped with an agitation means for agitating the agitation media around and in contact with the metal parts;

(c) means for transporting the metal parts from the booster furnace to the agitation container;

(d) a sand reclamation device associated with the agitation container for collecting residual sand removed from the metal parts in the agitation container;

(e) an agitation media reclamation device associated with the agitation container for collecting the agitation media from the agitation container after the agitation media has flowed through the agitation container and has cleaned and quenched the metal parts; and (f) a cooling means associated with the agitation media reclamation device for reducing the temperature of the agitation media collected by the agitation media reclamation device;

wherein the agitation media partially filing the agitation container has a temperature lower than the pre-tempering temperature of the metal parts, adequate to temper the metal parts; and wherein the agitation media is smaller in size than the metal parts and is of a size and composition simultaneously adequate to (a) downquench the metal parts by contact, and (b) clean the residual adhering sand from the metal parts by impact.

14. The apparatus of claim 13, wherein said booster furnace is a luminous wall gas-fired booster furnace.

15. The apparatus of claim 13, wherein said booster furnace raises the temperature of the metal parts to about 1500°-1700° F.

16. The apparatus of claim 13, wherein said agitation container has perforations through the side of the container sized to allow the agitation media and sand to pass therethrough.

17. The apparatus of claim 13, wherein said heat sink agitation media enters the agitation container at about 700° F.

18. The apparatus of claim 13, wherein said agitation media is selected from the group consisting of steel and copper shot.

19. The apparatus of claim 13, wherein said sand reclamation device is a conveyor device located below the agitation container.

20. The apparatus of claim 13, wherein said cooling means is an open-air conveyor device having a sufficient length to allow cooling of the agitation media for refilling the agitation container.

21. The apparatus of claim 13, wherein said agitation media reclamation device is a screened conveyor located below agitation container sized to capture the agitation media and allow the sand to pass therethrough.

22. The apparatus of claim 19, wherein the screen of said screened conveyor is formed of an electromagnetic material to enhance the capturing of metallic agitation media.

23. The apparatus of claim 13, wherein said agitation container is a rotary drum.

24. The apparatus of claim 23, wherein said rotary drum has an inlet opening at one end and an outlet opening at the other end.

25. The apparatus of claim 24, wherein the agitation means comprises an internal worm screw attached within the interior of the rotary drum for urging the metal parts, agitation media, and sand through the drum from the inlet opening to the outlet opening.

26. The apparatus of claim 24, further comprising an entry spout at the inlet opening of the rotary drum for filling the rotary drum with agitation media.

27. The apparatus of claim 24, wherein said rotary drum has perforations near the outlet opening of the drum sized to permit agitation media and sand inside the drum to pass therethrough.

28. The apparatus of claim 27, wherein said perforations are located at about 10–15% of the length of the drum nearest the outlet opening.

29. The apparatus of claim 13, wherein the booster furnace raises the temperature of the parts to between about 1500° F. and about 1700° F.

30. The apparatus of claim 13, wherein the agitation media has a diameter of at least about 1 millimeter.

31. In a foundry including means for demolding hot, sand-cast metal parts from sand molds in which the parts are cast, the improvement comprising:

a booster furnace for receiving the hot, demolded, sand-cast metal parts from said demolding means, said booster furnace being capable of raising the temperature of the parts to a pre-tempering temperature; and a quenching means including a rotary drum, a non-melting, non-reactive agitation media partly filling the drum, and a worm screw in the drum for urging the media and the parts through the drum;

the agitation media being of a type adequate to simultaneously (a) remove heat from the parts of a rate sufficient to quench the parts and (b) clean the parts by impact;

wherein the booster furnace is located with respect to the demolding means such that the demolded parts do not cool below about 1400° F. before the parts are received in the booster furnace means.

32. The improvement of claim 31, wherein the booster furnace means is adapted to raise the temperature of the molded parts to about 1500°-1700° F.

33. The improvement of claim 31, wherein the agitation media is copper or steel shot having a diameter of at least about 1 mm.

34. In a foundry including means for demolding hot, sand-cast metal parts from sand molds in which the parts are cast, the improvement comprising:

an agitation container for receiving and agitating the demolded, sand-cast metal parts therein, and a non-melting, non-reactive agitation media partly filling the agitation container, the agitation media being of a type simultaneously adequate to (a) remove heat from the parts at a rate sufficient to quench the parts and (b) clean the parts by impact; and a booster furnace between the demolding means and the agitation container, for receiving hot, demolded sand-cast metal parts from the demolding means, said booster furnace being capable of raising the temperature of the parts to about 1500°-1700° F. prior to delivery of the parts to the agitation container, wherein the agitation container is located with respect to the demolding means such that the parts received in the agitation container have residual heat sufficient for heat treatment of the parts, and have not cooled below about 1400° F. prior to being received in the agitation container.

35. The improvement of claim 34, wherein the agitation container comprises a rotary drum and a worm screw in the drum for urging the agitation media and the metal parts through the drum.

36. The improvement of claim 34, wherein the agitation media is copper or steel shot having a diameter of at least about 1 mm.

* * * * *